US005613638A

United States Patent [19]

Blessing

[11] Patent Number: 5,613,638

[45] Date of Patent: Mar. 25, 1997

[54] HAND SHOWER

[75] Inventor: Gerd Blessing, Villingen-Schwenningen, Germany

[73] Assignee: Hans Grohe GmbH & Co., Germany

[21] Appl. No.: 532,237

[22] Filed: Sep. 22, 1995

Related U.S. Application Data

[63] Continuation of Ser. No. 210,561, Mar. 18, 1994, abandoned.

[30] Foreign Application Priority Data

Mar. 20, 1993 [DE] Germany ..... 43 08 991.7

[51] Int. Cl.[6] ..... B05B 1/18; E03C 1/10; A45D 19/02

[52] U.S. Cl. ..... 239/396; 239/530; 239/600

[58] Field of Search ..... 4/615; 239/310, 239/315, 380, 381, 383, 525, 530, 575, 582.1, 600, 396

[56] References Cited

U.S. PATENT DOCUMENTS

| | | | |
|---|---|---|---|
| 994,230 | 6/1911 | Yancey . | |
| 1,469,065 | 9/1923 | D'Arcy | 239/315 |
| 2,132,333 | 10/1938 | Wendell et al. | 239/530 |
| 2,586,480 | 10/1948 | Ras | 101/147 |
| 2,878,066 | 3/1959 | Erwin | 239/381 |
| 3,637,143 | 1/1972 | Shames et al. | 239/530 |
| 3,776,469 | 12/1973 | Joannon | 239/446 |
| 3,788,553 | 1/1974 | Heckman | 239/315 |
| 3,967,783 | 7/1976 | Halsted et al. | 239/102 |
| 4,126,335 | 11/1978 | Voss | 285/39 |
| 4,209,190 | 6/1980 | Fleischer | 285/15 |
| 4,501,441 | 2/1985 | Crews | 285/143 |
| 4,607,795 | 8/1986 | Ettlinger et al. | 239/530 |
| 4,634,053 | 1/1987 | Herzfeld et al. | 239/315 |
| 4,653,778 | 3/1987 | Alandy | 285/18 |
| 5,090,747 | 2/1992 | Kotake | 285/305 |
| 5,158,234 | 10/1992 | Magnenat et al. | 239/588 |
| 5,167,431 | 12/1992 | Maifredi | 285/319 |
| 5,297,735 | 3/1994 | Heimann et al. | 239/530 |

FOREIGN PATENT DOCUMENTS

| | | | |
|---|---|---|---|
| 966390 | 4/1975 | Canada | 239/446 |
| 2356400 | 1/1978 | France | 4/615 |
| 2450589 | 10/1980 | France . | |
| 2536774 | 6/1984 | France | 239/530 |
| 2028937 | 12/1971 | Germany | 239/530 |
| 7621072 | 10/1976 | Germany . | |
| 2731525 | 1/1978 | Germany . | |
| 2827847 | 1/1980 | Germany . | |
| 3324383 | 1/1984 | Germany . | |
| 3402545 | 8/1985 | Germany . | |
| 4020615 | 1/1992 | Germany | 239/530 |
| 4029419 | 3/1992 | Germany | 239/600 |
| 621494 | 2/1981 | Switzerland | 239/525 |
| 1426644 | 9/1988 | U.S.S.R. | 239/530 |
| 1377844 | 12/1974 | United Kingdom . | |
| WO90/10814 | 9/1990 | WIPO . | |
| 9211948 | 7/1992 | WIPO . | |

*Primary Examiner*—Andres Kashnikow
*Attorney, Agent, or Firm*—Eckert Seamans Cherin & Mellott

[57] ABSTRACT

A hand shower containing a shower head, a handle and a connection for the shower hose, has in the interior of its handle an insert part, which in the vicinity of its one end is connected to a line leading to the shower head and in the vicinity of its other end has the connection for the shower hose. The insert part can be used as a mounting support for different functional elements or can be part of different functional elements.

13 Claims, 3 Drawing Sheets

HAND SHOWER

This is a continuation of application Ser. No. 08/210,561, filed Mar. 18, 1994, now abandoned.

FIELD OF THE INVENTION

The invention relates to a hand shower having a handle, a shower head and a connection for connecting the hand shower to a shower hose.

BACKGROUND OF THE INVENTION

A hand shower is already known (DE-OS 41 16 932) in which the handle is constructed in the vicinity of its connection end as a high-speed coupling for the insertion of a plug of the hose pipe. The line for the water in the handle is constructed as a hose and in it engages the plug.

A device is also known, which serves to fix a hose to the handle of a shower (DE-OS 33 24 383), in which the handle also has an opening designed in such a way that the hose connection can be inserted and locked.

An insert part for the connection of a shower hose to a shower head is also known (EP-A-454 935). This insert is exclusively used for the connection of a shower hose to a hand shower.

The problem frequently arises in connection with hand showers, that they must contain functional parts, such as screens or sieves.

SUMMARY OF THE INVENTION

The problem of the invention is to provide a possibility for the design of hand showers, which can be provided in individual applications with different functional elements, without the storage requirements on the part of the manufacturer being increased.

To solve this problem the invention proposes a hand shower with a handle, a shower head located on one end of the handle, a passage for the water passing through the handle, a connection for connecting the hand shower to a hose, as well as an insert part, which is arranged in the handle, forms a passage for the water, is connected on its one side with a passage leading to the shower head and on the other side to a connection. The insert part can be fixed in the handle and arranged in the end region of the handle associated with the hose. Further aspects of the invention are also provided.

The insert part can be constructed for the reception of different functional parts having different connection types and the like. If a hand shower is to be designed for a different use, then the designer can completely adopt the design of the hand shower with the exception of the insert part and need only replace in his design the said insert part.

This more particularly applies if, according to a further development of the invention, the insert part does not form part of the handle or the passage and is instead manufactured as a separate component and fixed in the handle.

The invention more particularly proposes that the insert part has or forms a possibility for fixing the connection for the hose. For example, the insert part can have a thread into which is screwed a connecting piece.

The invention proposes that the insert part is located in the end region of the handle associated with the hose. This is advantageous if the insert part is to directly contain the connection possibility for the hose. Even if as the functional part a screen is to be provided, the arrangement of the screen at the end of the handle is advantageous for the replacement and/or cleaning of the screen.

The invention proposes that the insert part has a standardized shape. It can be fixed within the handle at the same point and always using the same fastening means, so that one hand shower shape can be used for the most varied insert parts.

In particular it can also be provided that the insert part has standardized dimensions. Thus, it is possible to adopt in unchanged manner the other parts of the shower, including the connection.

The invention proposes that the insert part is constructed for holding different functional parts. In this case one insert part can be used for the different showers. Optionally the insert part must be adapted by additional elements to the different functional parts.

It is also possible and is proposed by the invention, that the insert part is part of a functional element.

An example for a functional element is a screen or sieve, which is either directly constructed on the insert part or is insertable in the latter.

Another example for a functional element is an optionally adjustable restrictor for the water cross-section. For this purpose it can be provided that the handle has an opening rendering accessible the restrictor adjusting element.

Another functional element usable in the invention is a cartridge with an additive, e.g. a water-soluble detergent. It is also possible to have a cartridge with a disinfectant.

It is also possible to position in the insert part a back flow preventing means or an aerator.

According to a further development the insert part has an additional plug coupling or a connection possibility for a connecting line to a container, in which is contained a specific additive, e.g. a cosmetic product. In the manner of a water jet pump, the connecting line could be used for sucking in the cosmetic product.

According to the invention, the insert part is insertable in the handle and is fixed within the latter at the correct point with the aid of a locking device, e.g. a bayonet catch. It is possible for the fixing action only to be overcome with a tool. It is naturally also possible to carry out unlocking with the aid of a pushbutton or the like.

BRIEF DESCRIPTION OF THE DRAWINGS

Further features, details and advantages of the invention can be gathered from the following description of a preferred embodiment of the invention and the attached drawings, wherein show.

DETAILED DESCRIPTION OF THE PREFERRED EMBODIMENTS OF THE INVENTION

Figure 1:
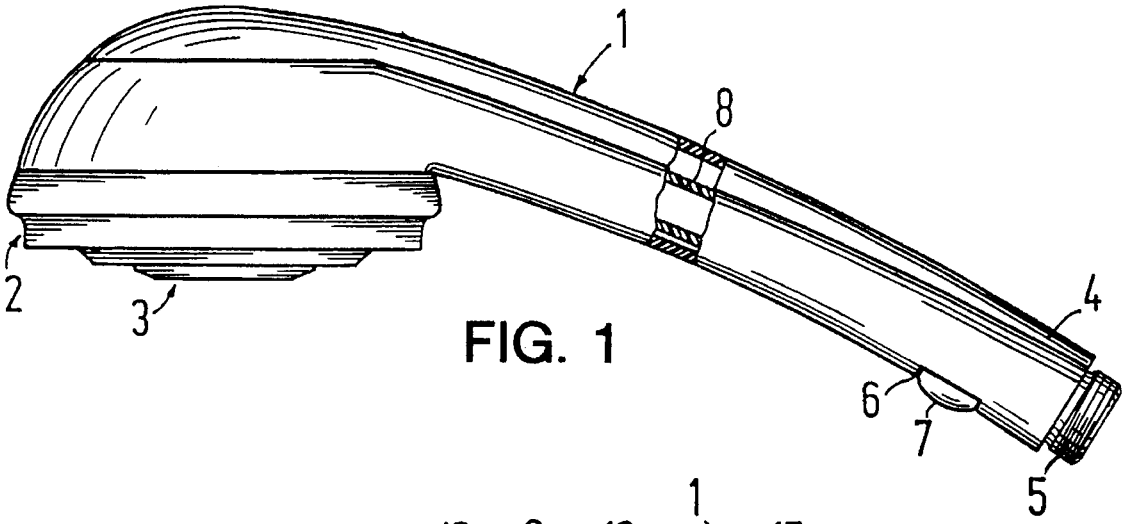
FIG. 1 A part sectional side view of a hand shower according to the invention.

The hand shower shown in FIG. 1 contains a handle 1, at whose one end is located a shower head 2. The shower head 2 contains a jet disk 3 from which the water is discharged. On the end of the handle 1 remote from the shower head 2 is provided a connection 4 for a shower hose, which in the represented embodiment has an external thread 5, onto which can be screwed a conventional cap nut. In the vicinity of the connection 4 the handle contains an opening 6 through which is accessible an operating element 7 for a restrictor located in the shower. The operating element 7 projects somewhat out of the opening 6.

As can be seen in the central area of FIG. 1, within the handle 1 is provided a through line 8, which forms a passage for the water.

Figure 2:
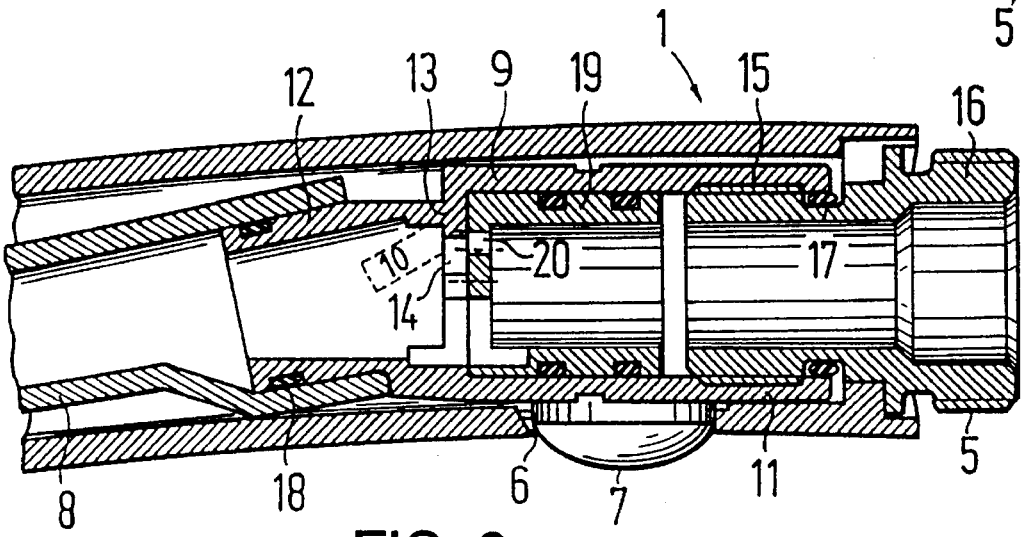
FIG. 2 On a larger scale a longitudinal section through the end region of the handle.

FIG. 2 shows on a larger scale a section through the connection end of the handle 1. In said end an insert part 9 is fixed in the interior of the handle 1 with the aid of screws, which pass through fastening clips or tongues 10, which will be described in greater detail hereinafter. The insert part 9 is formed by a hollow cylindrical element 11, on which is shaped in slightly sloping manner a connecting piece 12. Between said two parts is provided a partition 13 with individual passage openings 14. Both portions of the insert part 9 are open on their sides remote from the partition 13.

In the vicinity of the outer end of the hollow cylindrical element 11 is provided an internal thread 15, into which is screwed a connecting piece 16, which is sealed with respect to the insert part 9 with the aid of a packing 17. This connecting piece 16 has the aforementioned external thread 5. The connecting piece 16 is only fixed to the insert part 9 and as shown provides means for coupling a hose through insert part 9 to passage 8, in a straight linear alignment.

The connecting piece 12 projecting into the interior of the handle 1 is provided on its outside with an all-round groove having a packing or seal 18. The connecting piece 12 is inserted in the end of the line 8 over a distance roughly corresponding to the diameter of the connecting piece 12. There is no need for any other fixing of the line 8 to the connecting piece 12.

In the hollow cylindrical element 11 of the insert part 9 is provided between the partition 13 and the connecting piece 16 a rotatable sleeve element 19, which has a bottom 20 with passage openings. The sleeve element can be rotated about the rotation axis with the aid of an operating element 7 mounted on the insert part 9 outside the latter. As a result more or fewer large parts of the passage openings 14 in the partition 13 and the openings in the bottom 20 can be made to coincide. A rotation of the operating element 7 about the longitudinal axis of the handle consequently leads to a greater or lesser restriction of the water flow.

Without any significant design changes to the hand shower it would be possible to replace the sleeve element 19 with the passage openings in the bottom 20 by a sleeve element having a sieve or screen as the bottom or base. Therefore the insert element 19 can serve as a mounting and/or bearing means for different functional elements.

Figure 3:
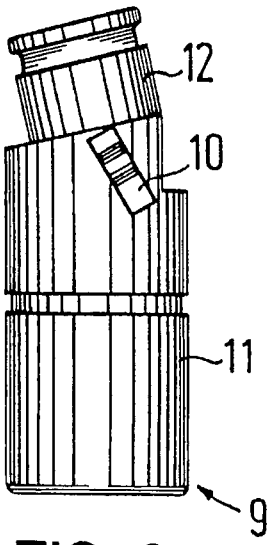
FIG. 3 A side view of an insert part according to the invention.
Figure 4:
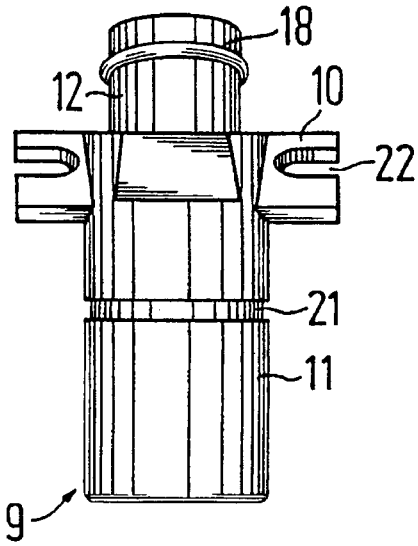
FIG. 4 A side view of the insert part from a direction offset with respect to FIG. 3.

For the better understanding of the insert part 9, FIGS. 3 and 4 are side views thereof. The hollow cylindrical element 11 is in the form of a straight circular cylinder and contains in its central region an all-round groove 21 extending over its circumference and which can be used e.g. for guiding the operating element 7.

In the vicinity of the transition between the connecting piece 12 and the hollow cylindrical part 11 of the insert part 9 are provided two approximately radially directed fixing clips or tongues 10 on the insert part 9 and which in each case have a U-shaped slot 22. From the left bottom side in FIG. 3 a screw can be inserted through the said slot and is screwed into a corresponding receptacle in the handle 1, so that the insert part 9 is firmly screwed in the handle 1. Thus, the insert part 9 is so connected to the handle that it can be used for fixing the connecting piece 16 for the shower hose.

Figure 5:
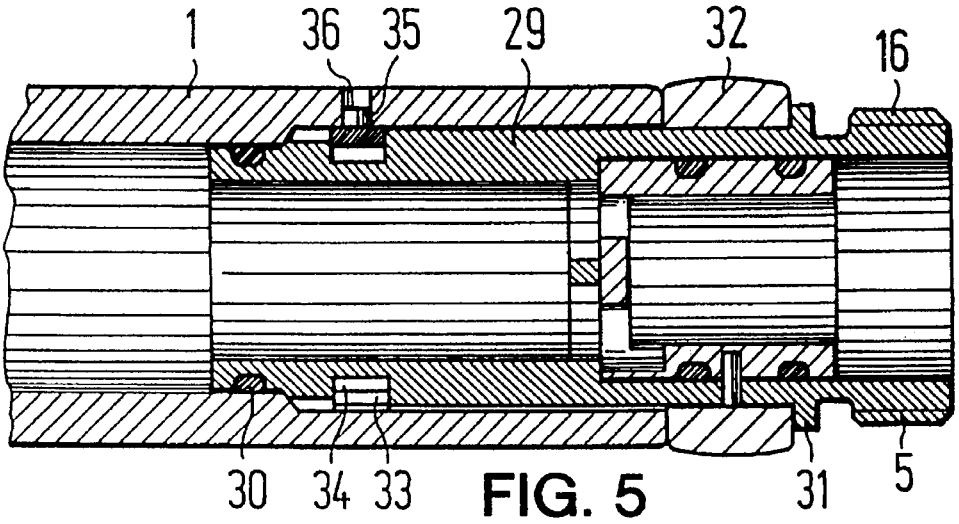
FIG. 5 A longitudinal section through the end region of a handle in a second embodiment.

Whereas in the embodiments of FIGS. 1 to 4 the insert part was constructed for the reception of a restrictor and a connection, FIG. 5 shows a further insert part, which can be inserted in the shower handle 1 and locked there. The insert part 29 is tubular and has an external diameter corresponding to the internal diameter of the handle in this area. This permits the easy insertion of the insert part 29. A packing 30 located in the end region is provided for sealing purposes. The insertion is limited in that a handle element 32 engages against the front edge of the handle 1. In the outside of the insert part 29 is formed a groove 33, in which is inserted a spring washer 34. The spring washer has an outer stud-like member 35, which engages in a corresponding opening 36. This fixes the insert part 29 in the axial and circumferential direction. For unlocking purposes the user can radially inwardly displace the stud 35 with the aid of a pin, so that the locking effect is removed.

In the embodiment according to FIG. 5 the insert part 29 again contains a restrictor, which can be adjusted with the aid of the handle element 32. Details of the restrictor correspond to that shown in FIG. 2. At the outer end of the insert part 29 a connection 16 for the shower hose and having an external thread 5 is constructed in one piece.

The insert part shown in FIG. 5 can, without its external dimensions or the handle end having to be modified, also be used for receiving other functional elements, e.g. a soap cartridge or the like.

Figure 6:
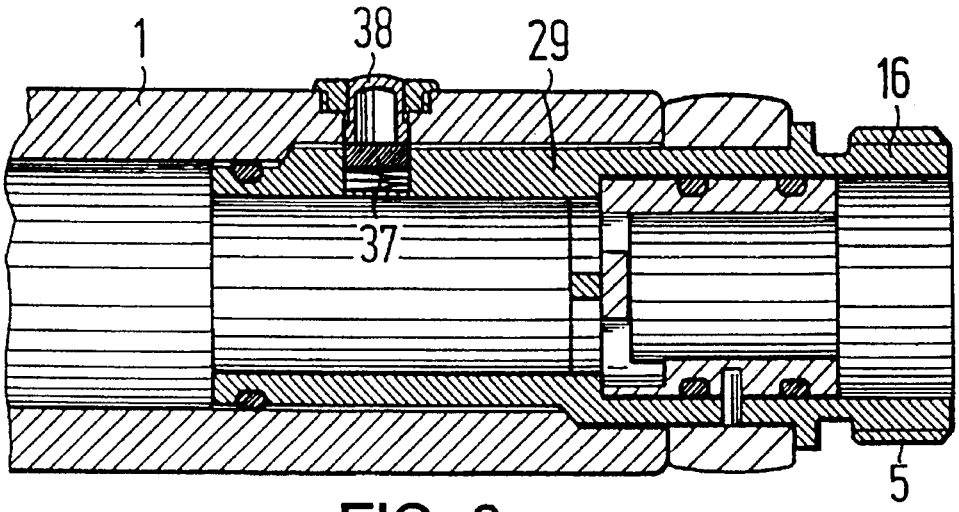
FIG. 6 A section corresponding to FIG. 5 in the case of another embodiment.

The insert part 29 of FIG. 6 differs from that of FIG. 5 only through the different nature of the fixing. In place of a groove 33 is provided a single depression with a blocking member 37 which is under spring tension and which is inserted in an opening by the spring. In said opening is provided a pushbutton 38, whose outward displacement is limited. FIG. 6 shows the unlocking state. The pushbutton 38 is inserted to such an extent that the separating line between the blocking member 37 and the pushbutton 38 coincides with the separating face between the handle 1 and the insert part 29.

Figure 7:
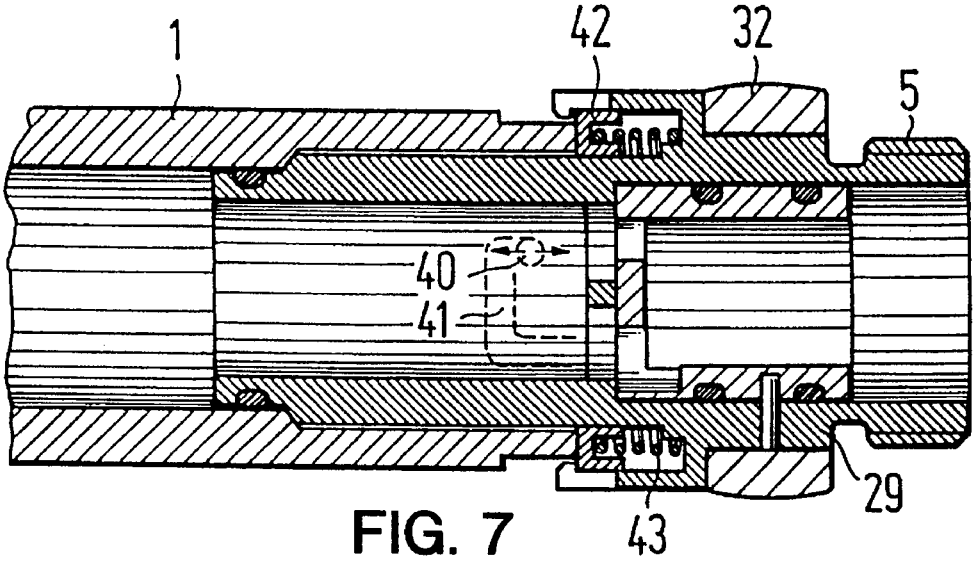
FIG. 7 A section corresponding to FIGS. 5 and 6 in a further embodiment.

In the case of the insert part 29 of FIG. 7 a bayonet catch 40 is provided on the outside and engages in a correspondingly shaped slot 41. On the side of the operating member 32 facing the handle 1 is provided a pressing device 42, which is operated by a spring 43. For both opening and closing the bayonet catch the tension of the spring 43 must be overcome.

For reasons of simplicity, the embodiments of FIGS. 1–7show an insert part having a restrictor as the functional element. However, the insert part is constructed for holding different functional parts.

Figure 8:
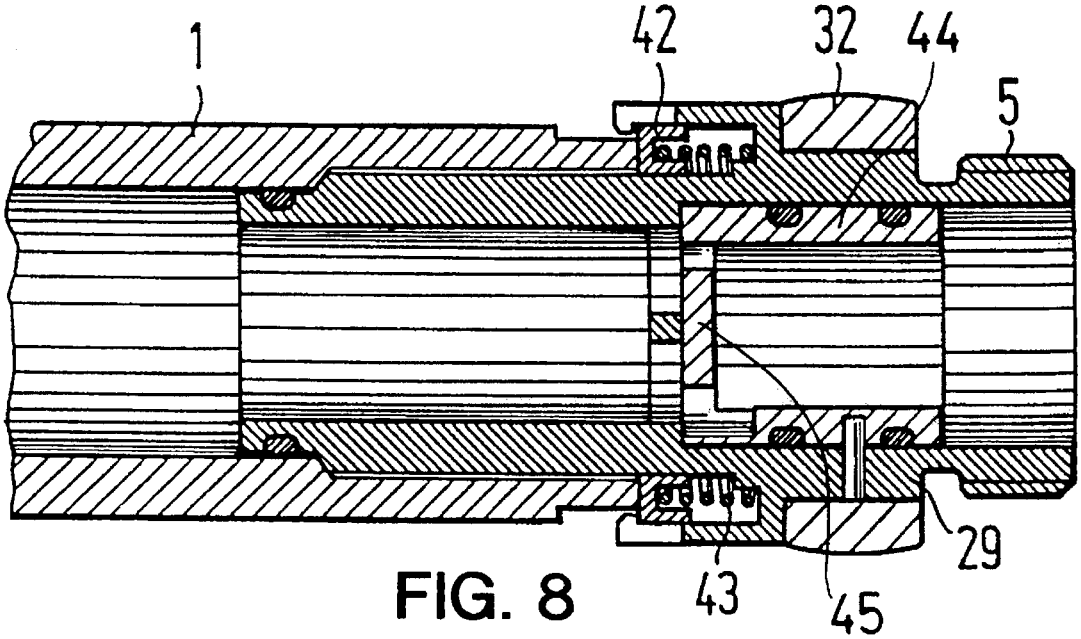
FIG. 8 A section corresponding to FIG. 7 in a further embodiment showing an insert part fitted with a functional element in block diagram form.
Figure 9:
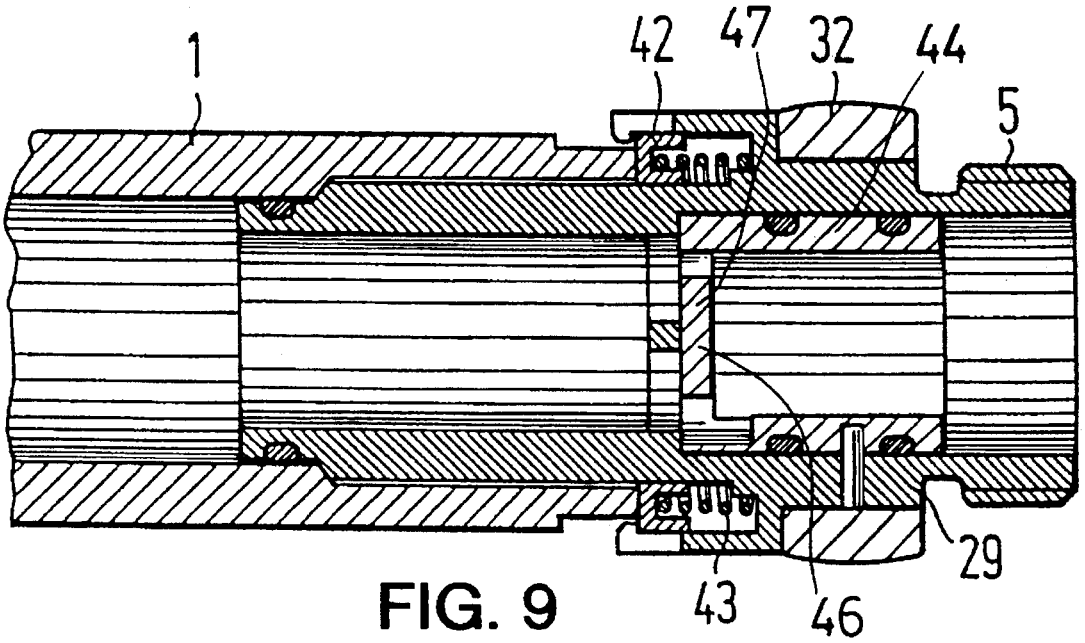
FIG. 9 A section corresponding to FIG. 7 in a further embodiment showing an insert part fitted with a functional element in block diagram form, namely a cartridge with an additive.

FIG. 8 shows an insert part having a sleeve member 44 fitted with a functional element 45. The functional element 45 as shown can be one of a screen or sieve, a back flow preventer or an aerator. FIG. 9 shows an insert part having a sleeve member 44 fitted with a cartridge 46 with an additive 47, e.g., a water-soluble detergent or disinfectant.

I claim:

1. A hand shower comprising:

a handle, a shower head located on one end of the handle, means defining a passage for water passing through the handle to the shower head, a replaceable insert part formed with a hollow operable to hold different functional elements, said insert part having a means for fixing the insert part within the handle adjacent to an other end of the handle at which the hand shower is attachable to a hose via a connection providing means for connecting the hand shower to the hose, a functional element completely retained within said hollow and wherein the insert part forms a passage for the water, is connected on one side with the passage leading to the shower head and on an other side to the connection, the connection, insert part containing the functional element and passage being arranged along a line, and wherein the insert part is disposed substantially completely inside the handle along said line.

2. The hand shower according to claim 1, wherein the connection for the hose is fixed to the insert part.

3. The hand shower according to claim 1, wherein the insert part has a standardized shape.

4. The hand shower according to claim 1, wherein the insert part has standardized dimensions.

5. The hand shower according to claim 1, wherein the functional element is an adjustable restrictor.

6. The hand shower according to claim 1, wherein the connection for the shower hose is integral with the insert part.

7. The hand shower according to claim 1, wherein the insert part is locked into the handle by locking means.

8. The hand shower according to claim 7, wherein the locking means is constituted by a bayonet catch.

9. The hand shower according to claim 1, wherein the functional element is a restrictor.

10. The hand shower according to claim 1, wherein the functional element is a screen.

11. The hand shower according to claim 1, wherein the functional element is a cartridge with an additive.

12. The hand shower according to claim 1, wherein the functional element is a return flow preventer.

13. The hand shower according to claim 1, wherein the functional element is an aerator.

* * * * *